US010954009B2

(12) United States Patent
Deering

(10) Patent No.: US 10,954,009 B2
(45) Date of Patent: Mar. 23, 2021

(54) CARTON FORMING OR FEEDING MACHINE WITH CONTROLLED MOTION

(71) Applicant: Kliklok LLC, Decatur, GA (US)

(72) Inventor: Jeff Deering, Loganville, GA (US)

(73) Assignee: KLIKLOK LLC, Decatur, GA (US)

( * ) Notice: Subject to any disclaimer, the term of this patent is extended or adjusted under 35 U.S.C. 154(b) by 1021 days.

(21) Appl. No.: 15/058,561

(22) Filed: Mar. 2, 2016

(65) Prior Publication Data

US 2016/0257089 A1 Sep. 8, 2016

Related U.S. Application Data

(60) Provisional application No. 62/126,907, filed on Mar. 2, 2015.

(51) Int. Cl.

| | |
|---|---|
| ***B31B 50/02*** | (2017.01) |
| ***B31B 50/04*** | (2017.01) |
| ***B31B 50/06*** | (2017.01) |
| ***B31B 50/80*** | (2017.01) |
| ***B65B 5/02*** | (2006.01) |
| ***B31B 50/07*** | (2017.01) |
| ***B65B 43/28*** | (2006.01) |
| ***B31B 50/78*** | (2017.01) |

(Continued)

(52) U.S. Cl.

CPC ..... *B65B 5/024* (2013.01); *B31B 50/024* (2017.08); *B31B 50/062* (2017.08); *B31B 50/07* (2017.08); *B31B 50/782* (2017.08); *B31B 50/80* (2017.08); *B31B 50/804* (2017.08); *B65B 35/10* (2013.01); *B65B 35/56* (2013.01); *B65B 43/285* (2013.01); *B31B 50/06* (2017.08); *B31B 2100/00* (2017.08); *B31B 2110/35* (2017.08); *B31B 2120/302* (2017.08)

(58) Field of Classification Search

CPC ..... B31B 50/024; B31B 50/06; B31B 50/062; B31B 50/80; B31B 50/782; B31B 50/804; B31B 50/07; B31B 2100/00

USPC ..... 493/313, 315; 53/443, 473, 147

See application file for complete search history.

(56) References Cited

U.S. PATENT DOCUMENTS 4,245,604 A 1/1981 Lahiff
4,881,934 A * 11/1989 Harston ..... B65H 3/42 493/315

(Continued)

FOREIGN PATENT DOCUMENTS

DE 102012209987 A1 12/2013

*Primary Examiner* — Andrew M Tecco
*Assistant Examiner* — Nicholas E Igbokwe
(74) *Attorney, Agent, or Firm* — King & Schickli, PLLC

(57) ABSTRACT

A machine for forming a carton from a carton blank. The machine includes at least one mover including a picker for picking the carton blank from the hopper and associating the carton blank with the mover. A controlled motion track is provided for moving the at least one mover and picker along a path of travel to a stationary position for engaging the carton blank in the hopper. A further aspect relates to maintaining a suction force on the carton blank during conveyance, including along a linear portion of the track associated with a lugged conveyor for assisting in erecting the blank into a carton. Another aspect relates to a rotatable bucket for receiving and supporting the product, and a controlled motion track for positioning the bucket and associated product for delivery to the carton. Related methods are also described.

17 Claims, 16 Drawing Sheets

(51) Int. Cl.

| | |
|---|---|
| ***B65B 35/56*** | (2006.01) |
| ***B65B 35/10*** | (2006.01) |
| *B31B 120/30* | (2017.01) |
| *B31B 100/00* | (2017.01) |
| *B31B 110/35* | (2017.01) |

(56) References Cited

U.S. PATENT DOCUMENTS

| | | | | |
|---|---|---|---|---|
| 5,215,515 | A * | 6/1993 | Bershadsky | B31B 50/00 493/315 |
| 5,257,888 | A * | 11/1993 | Kronseder | B65G 47/904 294/65 |
| 5,715,657 | A | 2/1998 | Mondani et al. | |
| 5,966,897 | A | 10/1999 | Kirka et al. | |
| 6,383,123 | B1 | 5/2002 | Ehring | |
| 7,134,258 | B2 | 11/2006 | Kalany et al. | |
| 8,047,530 | B2 * | 11/2011 | Harston | B65B 43/185 271/100 |
| 8,079,944 | B2 | 12/2011 | Reuteler et al. | |
| 8,182,406 | B2 | 5/2012 | Reuteler et al. | |
| 8,387,349 | B2 | 3/2013 | Bellante | |
| 8,783,000 | B2 | 7/2014 | Wintring et al. | |
| 2003/0136086 | A1 * | 7/2003 | Kalany | B65B 35/24 53/443 |
| 2003/0230941 | A1 * | 12/2003 | Jacobs | B60L 15/38 310/12.19 |
| 2007/0257416 | A1 * | 11/2007 | Ford | B65B 43/185 271/91 |
| 2013/0121799 | A1 * | 5/2013 | Lundgren | B65B 43/265 414/752.1 |
| 2014/0290182 | A1 | 10/2014 | Wintring et al. | |
| 2015/0139772 | A1 * | 5/2015 | Rapp | B65B 43/145 414/796.5 |
| 2015/0143777 | A1 | 5/2015 | Rapp et al. | |

* cited by examiner

CARTON FORMING OR FEEDING MACHINE WITH CONTROLLED MOTION

This application claims the benefit of U.S. Provisional Patent Application Ser. No. 62/126,907, the disclosure of which is incorporated herein by reference.

FIELD OF THE INVENTION

This disclosure relates to the cartoning arts and, more particularly, to a carton forming or feeding machine using controlled motion.

BACKGROUND

Machines for forming cartons from blanks, and then delivering a product for loading into the carton, are well known. Typically, the carton is erected from a blank during a "pick and place" operation using a machine known in the vernacular as a "rotary feeder." Versions of rotary feeders may be found in U.S. Pat. Nos. 4,881,934 and 8,047,530, as but two examples.

While these types of machines work well for their intended purposes, the picking and erecting of the carton blank in a rotary environment requires a sophisticated arrangement of cams, gears, linkages, etc., and, thus, considerable engineering to develop and effort to maintain. Individualized control or independent adjustment of the particular structures used to pick and place the carton is usually not possible in this type of arrangement, which can lead to complications, especially when different sizes of cartons are being handled. The same is typically true for the corresponding machines used to deliver and then load product in the formed cartons, which loading sometimes requires reorienting the product for insertion into the carton from an open side prior to sealing.

Accordingly, a need exists for improved carton forming or feeding machines that avoid any one or all of the foregoing limitations, and perhaps others yet to be identified.

SUMMARY

In accordance with one aspect of the disclosure, a machine is provided for forming a carton from a carton blank in a hopper. The machine comprises at least one mover including a picker for picking the carton blank from the hopper and associating the carton blank with the mover. A controlled motion track is provided for moving the at least one mover and picker along a path of travel to a stationary position for engaging the carton blank in the hopper.

In one embodiment, the picker comprises an actuator for moving in a linear direction for engaging and withdrawing the carton blank from the hopper while the mover is in the stationary position. The picker may comprise at least one vacuum cup for engaging the carton blank, the vacuum cup being mounted to the mover by a support including a vacuum source for supplying vacuum pressure to the vacuum cup. A latch may be provided for latching the picker in a home position and a rotary union may be provided for delivering gas to the support.

The track may include a curved portion corresponding to the location of the hopper and a linear portion. A takeaway conveyor may be provided for receiving the carton blank during erection, the takeaway conveyor being located opposite a linear portion of the track. In one embodiment, a plurality of movers are provided, and the controlled motion track is adapted for controlling the movement of each mover to stop at the hopper. In one embodiment, the mover comprises a first mover, and further including a second mover having an actuator for moving in a linear direction for engaging and withdrawing the carton blank from the hopper while the mover is in the stationary position.

According to a further aspect of the disclosure, a machine for forming a carton from a carton blank in a hopper is provided. The machine comprises a plurality of movers, each including a picker connected to an actuator for causing the picker to pick the carton blank from the hopper. A controlled motion track is provided for delivering the movers and associated blanks to a position for erection of the blank into the carton, the track including a linear portion.

The controlled motion track may be adapted for moving the at least one mover and picker along a path of travel to a stationary position for engaging the carton blank in the hopper. The picker may comprise at least one vacuum cup for engaging the carton blank, the vacuum cup being mounted to the mover by a support including a vacuum source for supplying vacuum pressure to the vacuum cup. A rotary union may be provided for supplying gas to the support, and a latch may be provided for latching the picker in a home position.

The track may comprise a curved portion corresponding to the location of the hopper and a linear portion. A takeaway conveyor may be provided for receiving the carton blank during erection, the takeaway conveyor being located adjacent a transition from a return run of the track to a forward run. The takeaway conveyor may comprise lugs for assisting in erecting the carton from the carton blank during conveyance along the linear portion of the track by the combined action of the lugs and the picker.

A further aspect of the invention pertains to a machine for forming a carton from a carton blank. The machine comprises a controlled motion track having a curved portion and a linear portion, and a hopper for holding the carton blank, the hopper being located along the curved portion of the track. At least one mover is provided for moving along the track, the mover including at least one picker for engaging the carton blank in the hopper and conveying the carton blank along the curved portion of the track to the linear portion of the track. A conveyor, such as a lugged takeaway conveyor, is provided for receiving the carton blank and at least partially erecting it, the conveyor being located along the linear portion of the track, such that the picker engages the carton blank at least partially during erection by the conveyor. The picker may be adapted for applying suction to the carton blank during conveyance along the curved portion and the linear portion of the track.

According to a further aspect of the disclosure, a machine for feeding product for delivery to a carton is provided. The machine comprises a rotatable bucket for receiving and supporting the product, and a controlled motion track for positioning the bucket and associated product for delivery to the carton.

A cam follower assembly may also be provided for rotating the carrier from a first orientation for receiving the product from an infeed conveyor to a second orientation for delivering the product to an open end of a carton. The cam follower assembly comprises a Geneva wheel rotatably mounted to the carrier and a cam follower positioned at a fixed location along the track for engaging a groove in the Geneva wheel. A retainer may also be provided for retaining the product on or in the carrier, such as an actuator for engaging the product on delivery to the carrier. The controlled motion track may also be adapted for halting the bucket for receiving or releasing the product.

In one additional aspect, a carton feeder comprises a selectively movable linear actuator including a picker for picking a carton blank from a hopper solely in a linear direction.

Another aspect of the disclosure pertains to a method of forming cartons from carton blanks. The method comprises picking a carton blank from a hopper using a stationary mover associated with a continuous motion track adapted for controlling the stationary mover independent of another mover associated with the track. The method may further include the step of picking the carton blank in a purely linear direction.

Still another aspect of the disclosure pertains to a method of feeding a product for loading into a carton. The method comprises providing a controlled motion track including a plurality of independently movers, at least one including the product, and rotating the product associated with the mover between a first received orientation and a second orientation for loading the product into the carton. Each mover may include a carrier, and the step of rotating the product may comprise rotating the carrier from a first orientation for receiving the product from an infeed conveyor to a second orientation for delivering the product to an open end of the carton.

Still a further aspect of this disclosure pertains to a method of forming a carton. The method comprises conveying a support supporting an actuator including a picker for picking a carton blank from a hopper in a linear direction, halting the conveying of the support for engaging the actuator with the carton blank, and conveying the support for at least partially erecting the carton blank into the carton.

Yet another aspect of the disclosure pertains to a method of forming a carton from a carton blank, comprising: (1) conveying the carton blank along a curved portion of a conveyor while applying suction to the carton blank; and (2) erecting the carton along a linear portion of the conveyor while maintaining the suction on the carton blank. The method may further include the step of picking the carton blank from a hopper positioned along the curved section using suction.

As can be appreciated, the machines and methods described above may be used together or apart from each other.

DESCRIPTION

Figure 1:
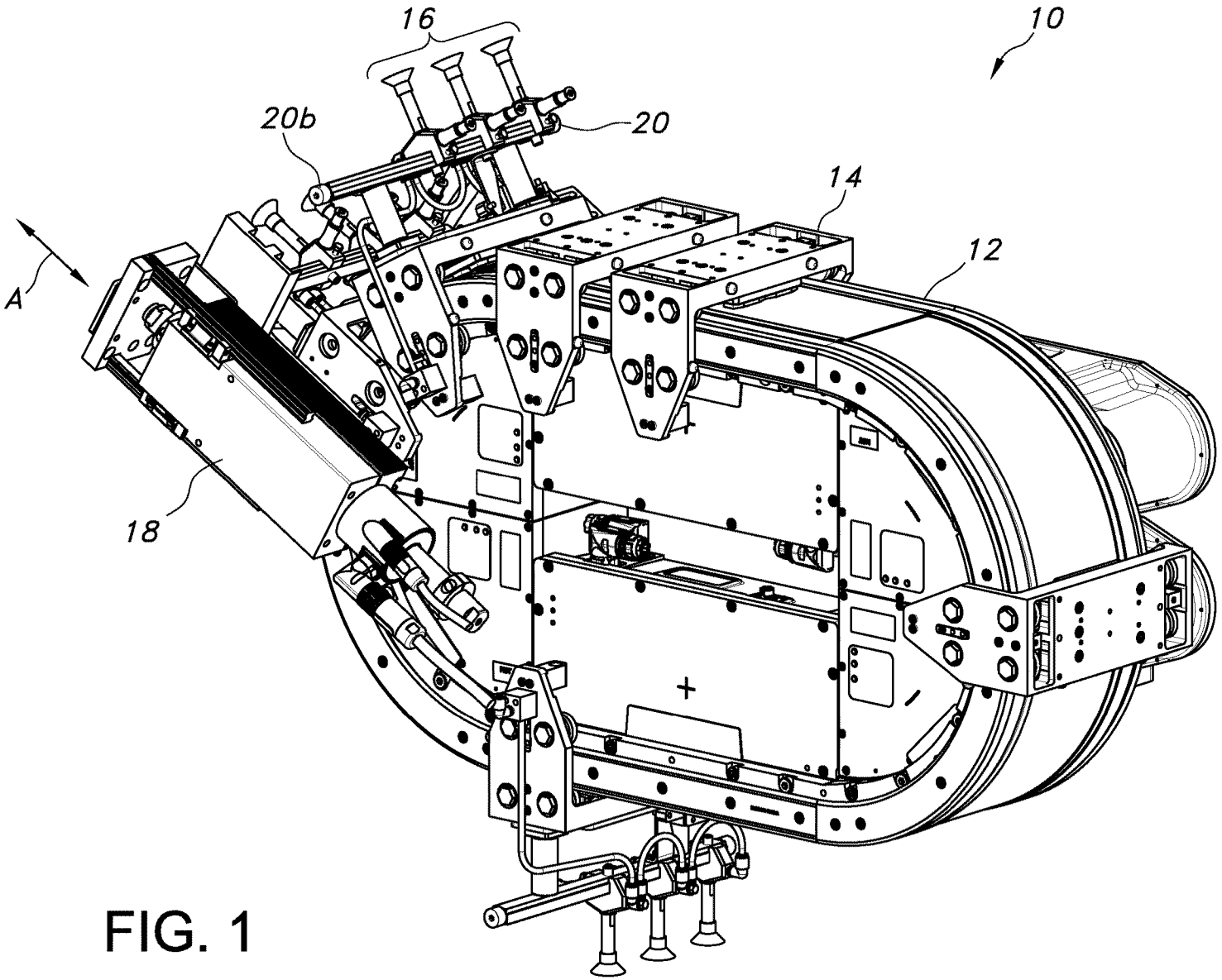
FIG. 1 is a perspective view of one embodiment of a continuous motion device for a carton forming and feeding machine.

Reference is now made to FIG. 1, showing an overall perspective view of one embodiment of a carton forming machine 10. In the illustrated embodiment, the machine 10 includes a track 12 supporting one or more movers 14. Each mover 14 in turn supports a carrier, which may comprise a suction device, which may include selectively actuatable vacuum cups 16. Although not all movers 14 are shown with this structural arrangement in FIG. 1, it should be appreciated that all may be identically constructed.

Figure 2:
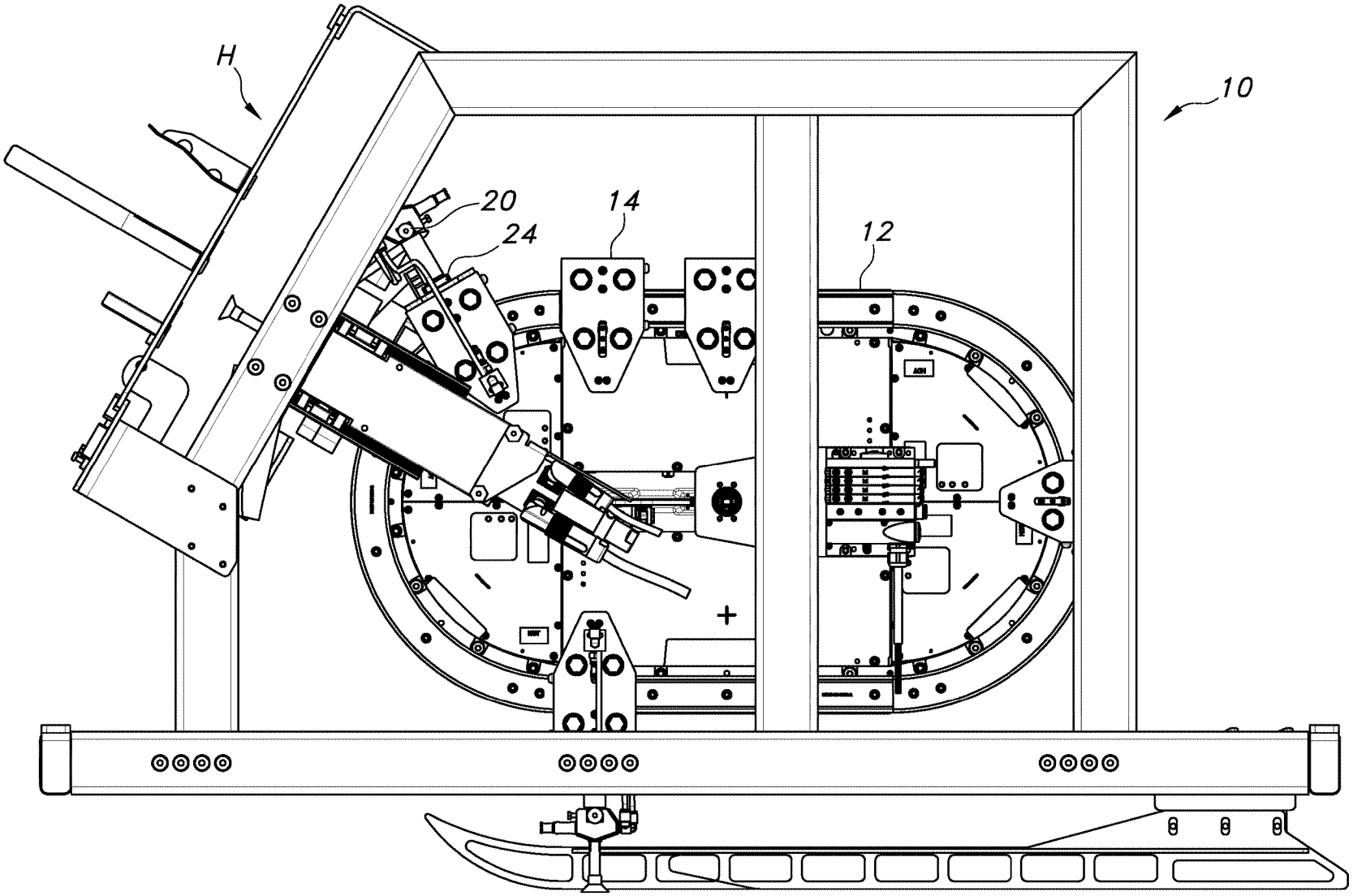
FIG. 2 is a side view of a carton forming and feeding machine including the continuous motion device of FIG. 1.

The cups 16 serving as the carrier engage the carton blank B in a hopper H (FIGS. 2 and 5), which may be positioned along, opposite or above a curved portion of the track 12 corresponding to a return run (that is, where the carriers transition from forward movement along the upper end of the track 12 to the lower end). Once engaged, the cups 16 via the associated mover 14 (and via the suction force provided) advance the blank B to a position for erection into a carton C (including possibly by assisting in the erection process, and also possibly followed by further conveyance for product loading purposes, as outlined in more detail in the following description).

The nature of the track 12 is such that the movers 14 may be individually advanced or halted at any point along an endless path of travel, and at a selected speed, thus providing a measure of controlled motion (which may include a lack thereof). The track 12 thus creates a "pitchless" arrangement (that is, there is no amount of fixed spacing between adjacent movers 14). One particular arrangement of such a track 12 is distributed by Rockwell Automation, Inc. under the trademark ITRAK. Such continuous movement arrangements are described in U.S. Pat. Nos. 8,896,241 and 6,876,107, as well as in U.S. Patent Application Publication Nos. 2014/0331888 and 2014/0265645, the disclosures of which are incorporated herein by reference.

Figure 3:
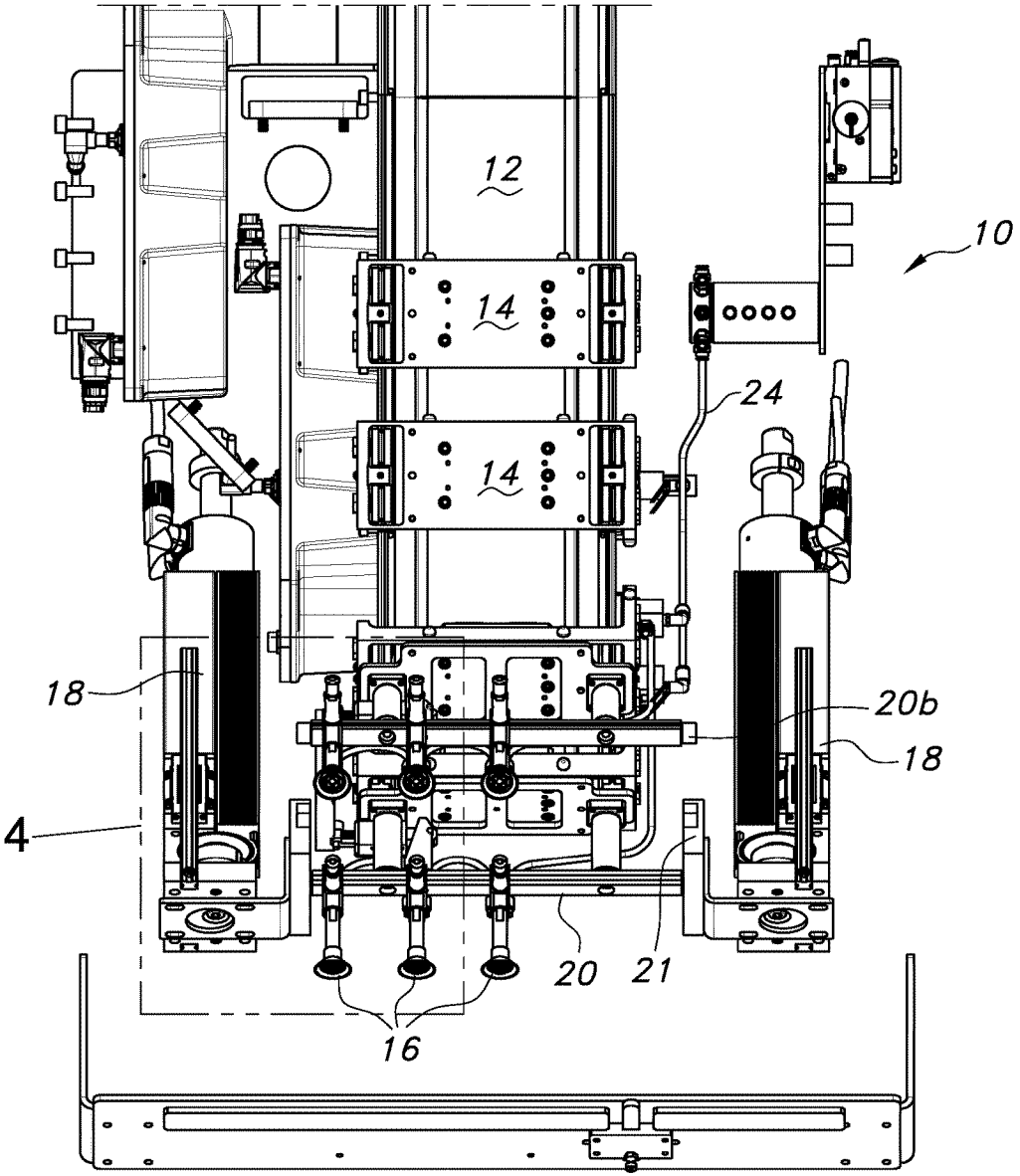
FIG. 3 is a partially cutaway top view of the machine of FIG. 2.
Figure 4:
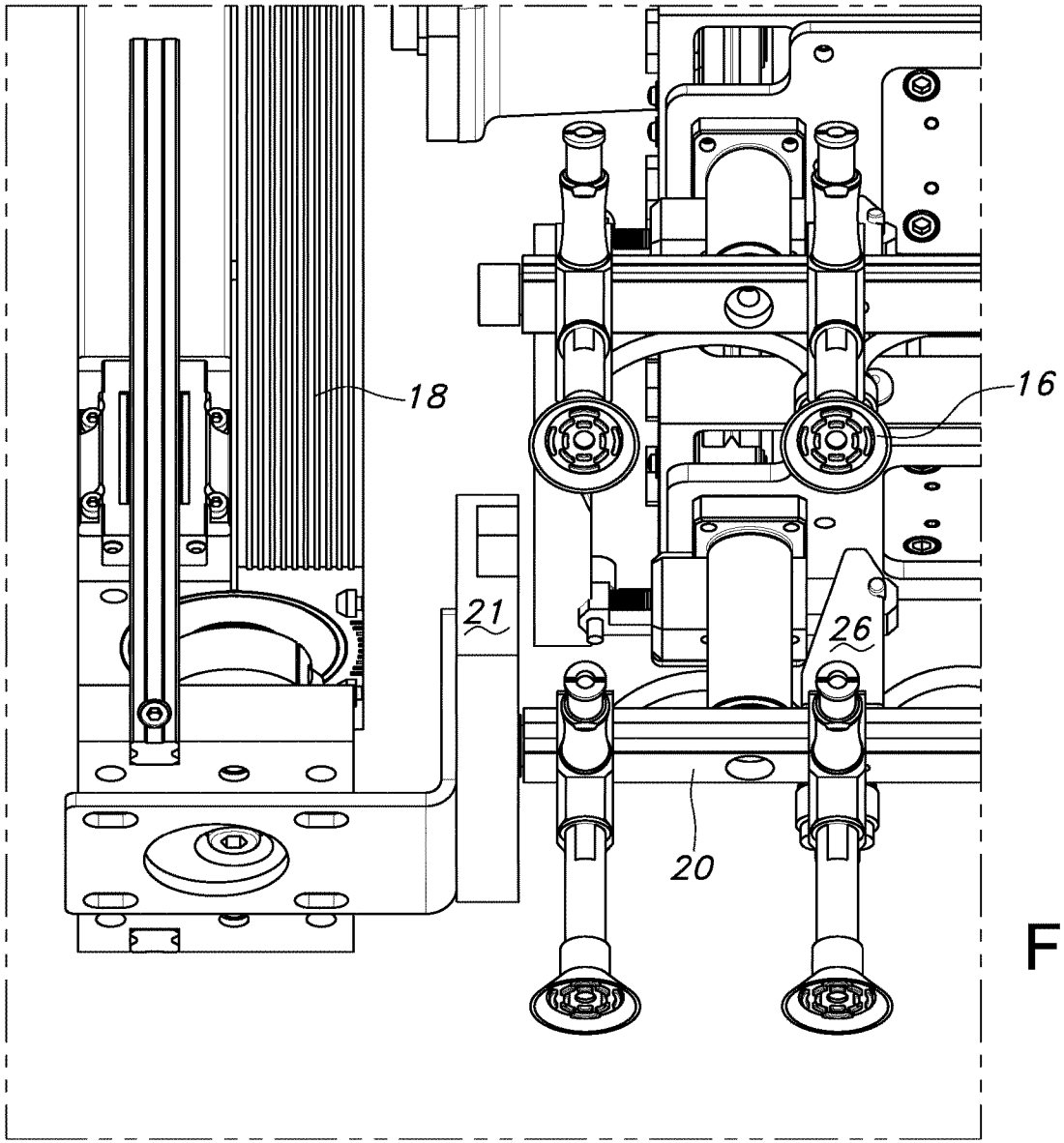
FIG. 4 is an enlarged portion of the view of FIG. 3.

Thus, with reference again to FIGS. 1 and 2, as well as FIGS. 3 and 4, it can be seen that each mover 14 may be advanced along the track 12 to a "pick" position for selecting the next-in-line blank B from the hopper H. To do so, one or more actuators 18, such as linear actuators (two shown, one for each side), may be associated with each mover 14 to advance a support 20 supporting the vacuum cups 16 to engage the blank B (note action arrow A and cam 21 in FIG. 4 for associating with a follower **20*b* connected to support 20). Thus, the carrier or cups 16 and the support 20 coupled with actuator 18** thus together may be considered to form a picker.

By supplying negative or vacuum pressure to the cups 16 (which may be achieved using a rotary union 22 to supply compressed air through a delivery line 24 to a vacuum generator (venturi) associated with support 20 to create the desired vacuum), the carton blank B may be engaged and the actuator 18 retracted to pick the blank in a secure, repeatable, and highly reliable fashion. Using the controlled motion feature of the track 12, the mover 14 may briefly stop at the pick point to ensure that a proper engagement is achieved.

As shown in FIG. 3, a selectively movable latch 26 may be associated with each mover 14 and the actuator 18 forming part of the picker in particular. This latch 26 may be used to ensure that the support 20 remains held in the retracted condition during continued conveyance, except when actuation is desired. The latch 26 may be movable in a transverse direction, and may pivot to associate with a pin or other portion of the support 20.

As should be appreciated, the arrangement provided means that the blank B may be drawn from the gate associated with the hopper H in a purely linear movement. Such is typically not possible using continuous rotary feed arrangements using cams and gears to effect the picking operation, since such halting or stopping is not possible.

Once the carton blank B is engaged and removed from the hopper H, the corresponding mover then may continue to advance along a curved portion 12*a* of the track 12 to rotate and reorient the blank for purposes of eventual erection. As noted, the halting or stopping may be momentary only, and need only transpire for as long as it takes for the carton blank B to move clear of the hopper or other holder.

It can be further understood that the linear movement is in the radial direction when the hopper H is located along a curved portion of the track 12. A line corresponding to the linear movement is thus generally orthogonal to a line tangent to the curved portion of the track 12. Of course, if the hopper H were positioned along a linear portion of the track 14, such as the upper portion or the lower portion, the line corresponding to the linear movement would be generally orthogonal with a line parallel to the conveying direction of the mover 14 along the linear portion.

Figure 5:
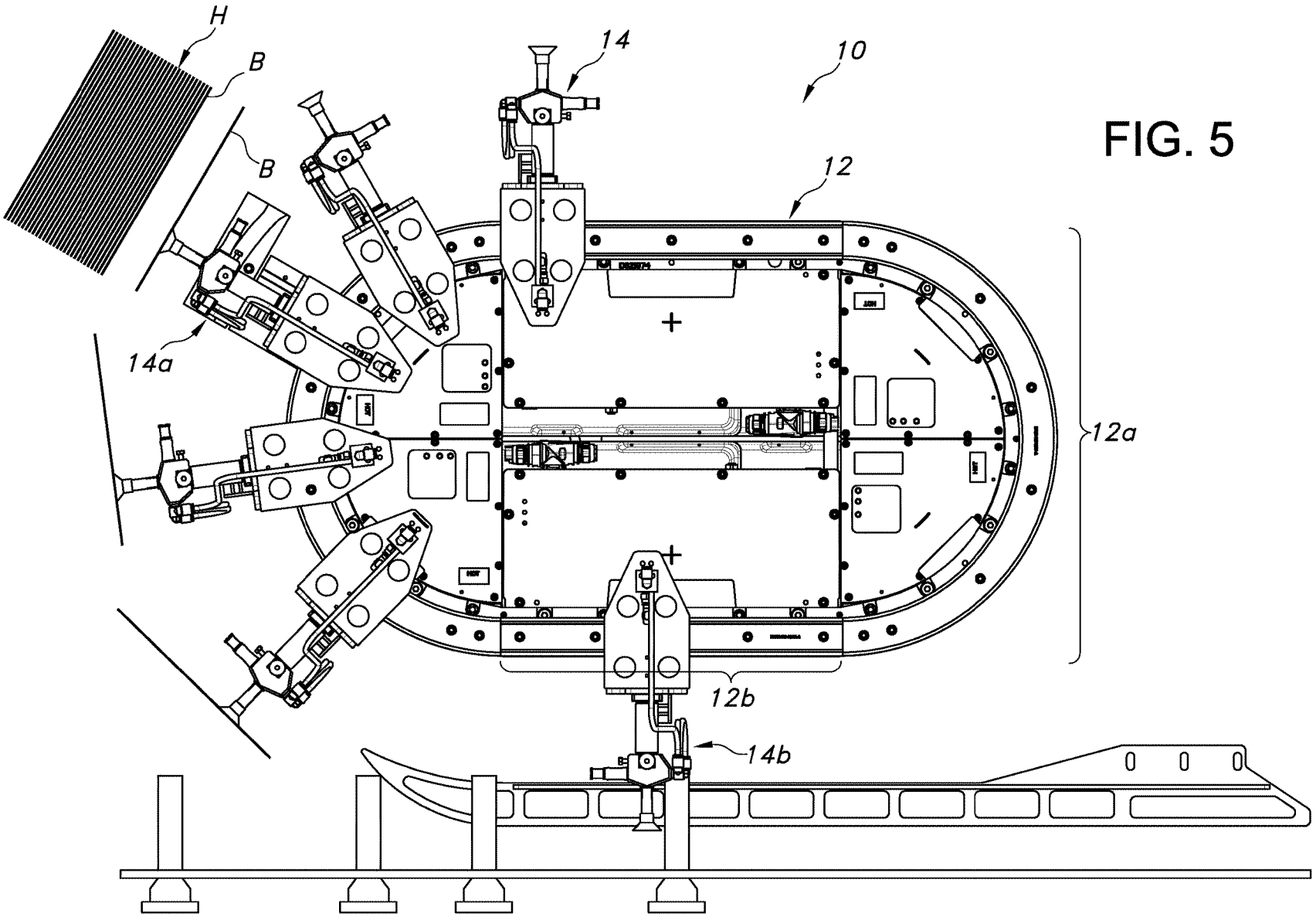
FIGS. 5-14 are sequential views of a carton forming and feeding operation using the disclosed machine with continuous motion.
Figure 6:
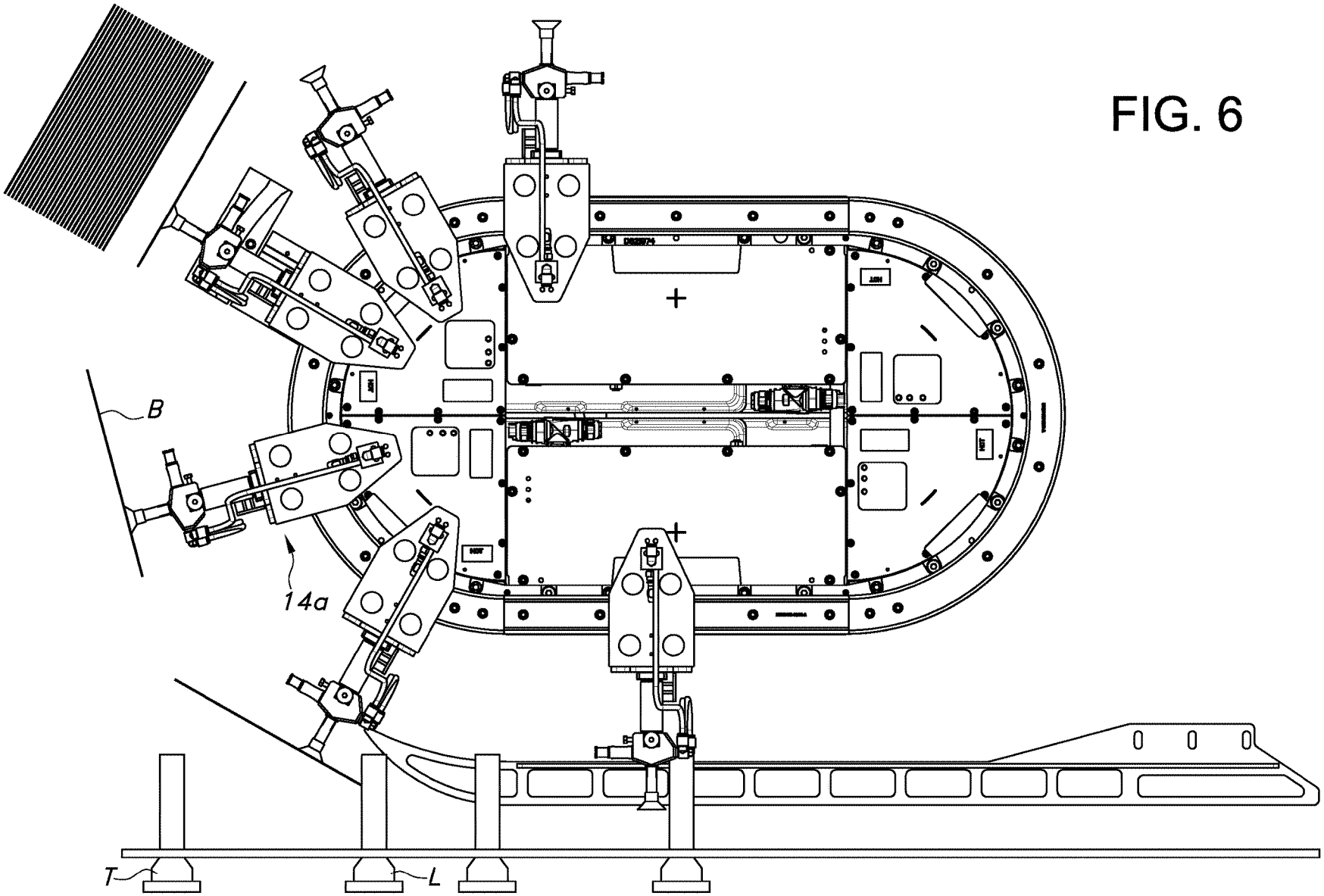
Figure 7:
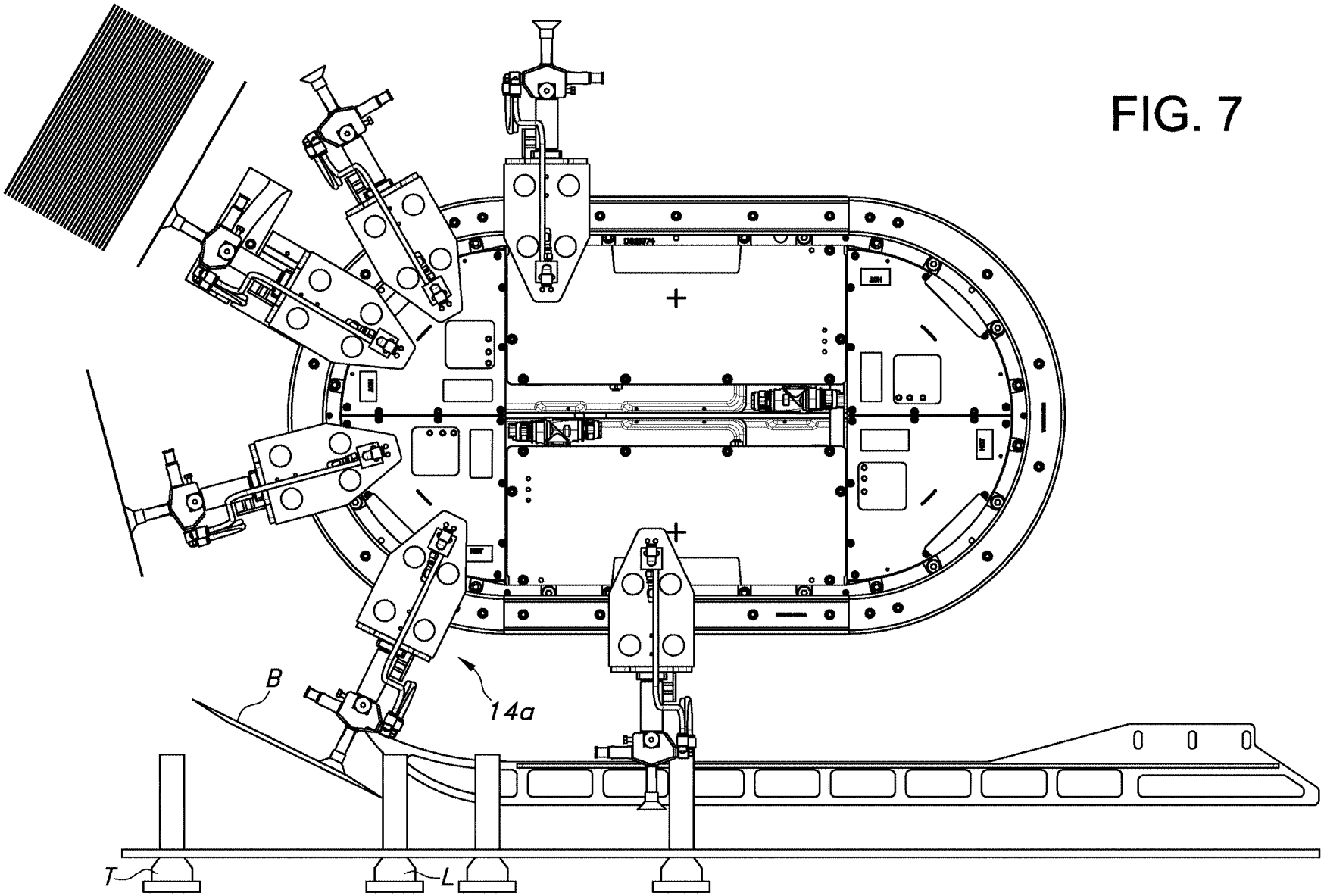
Figure 8:
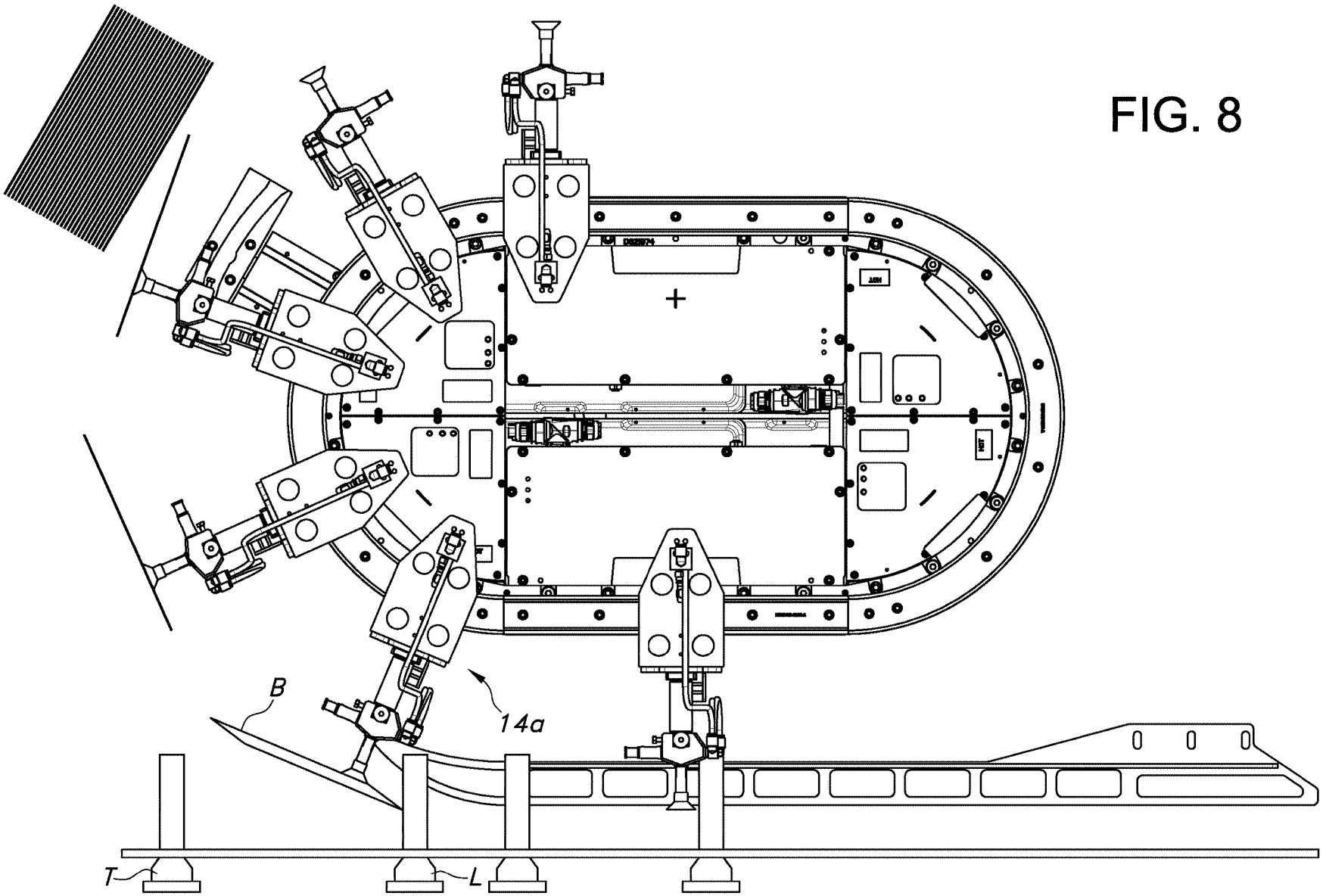
Figure 9:
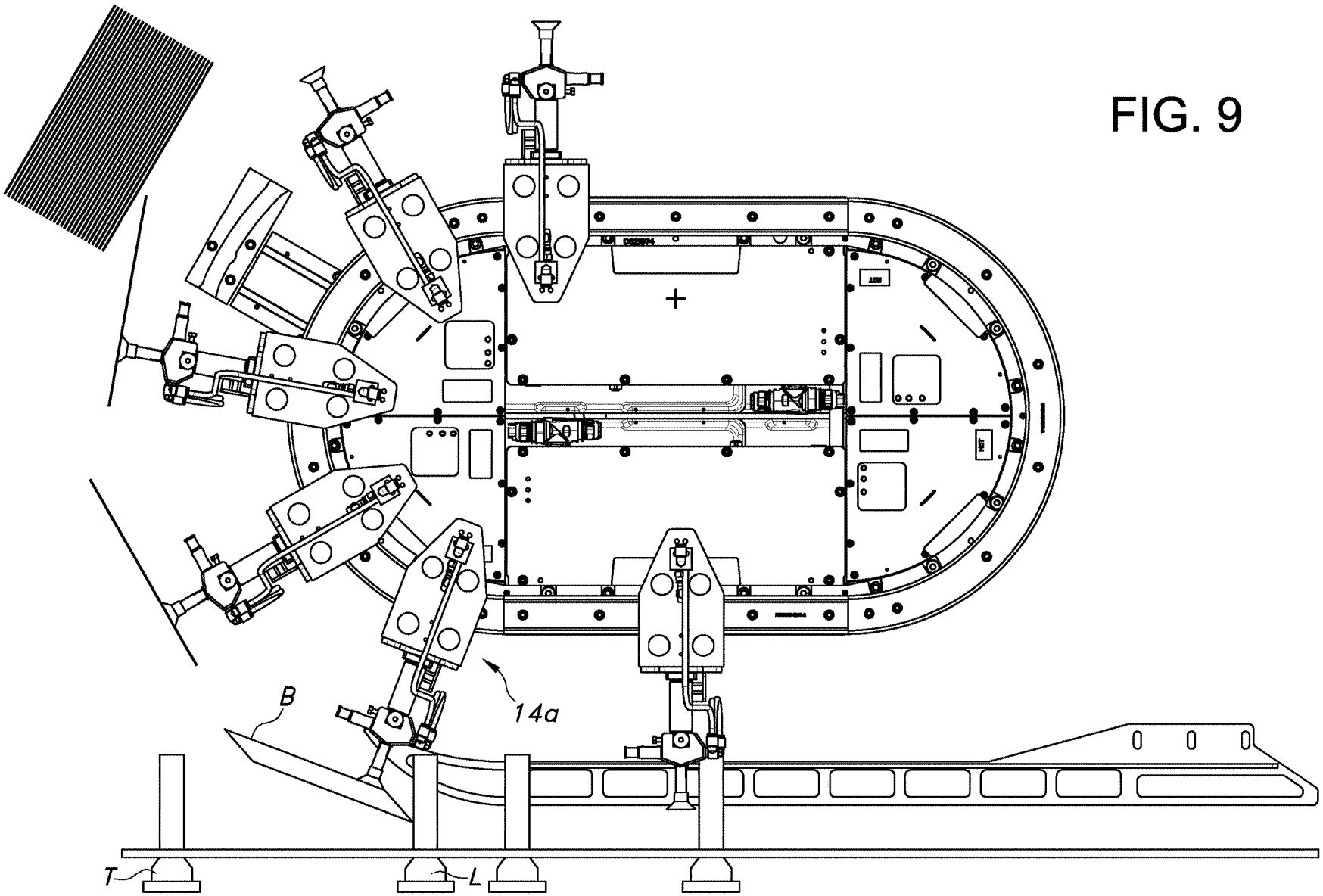
Figure 10:
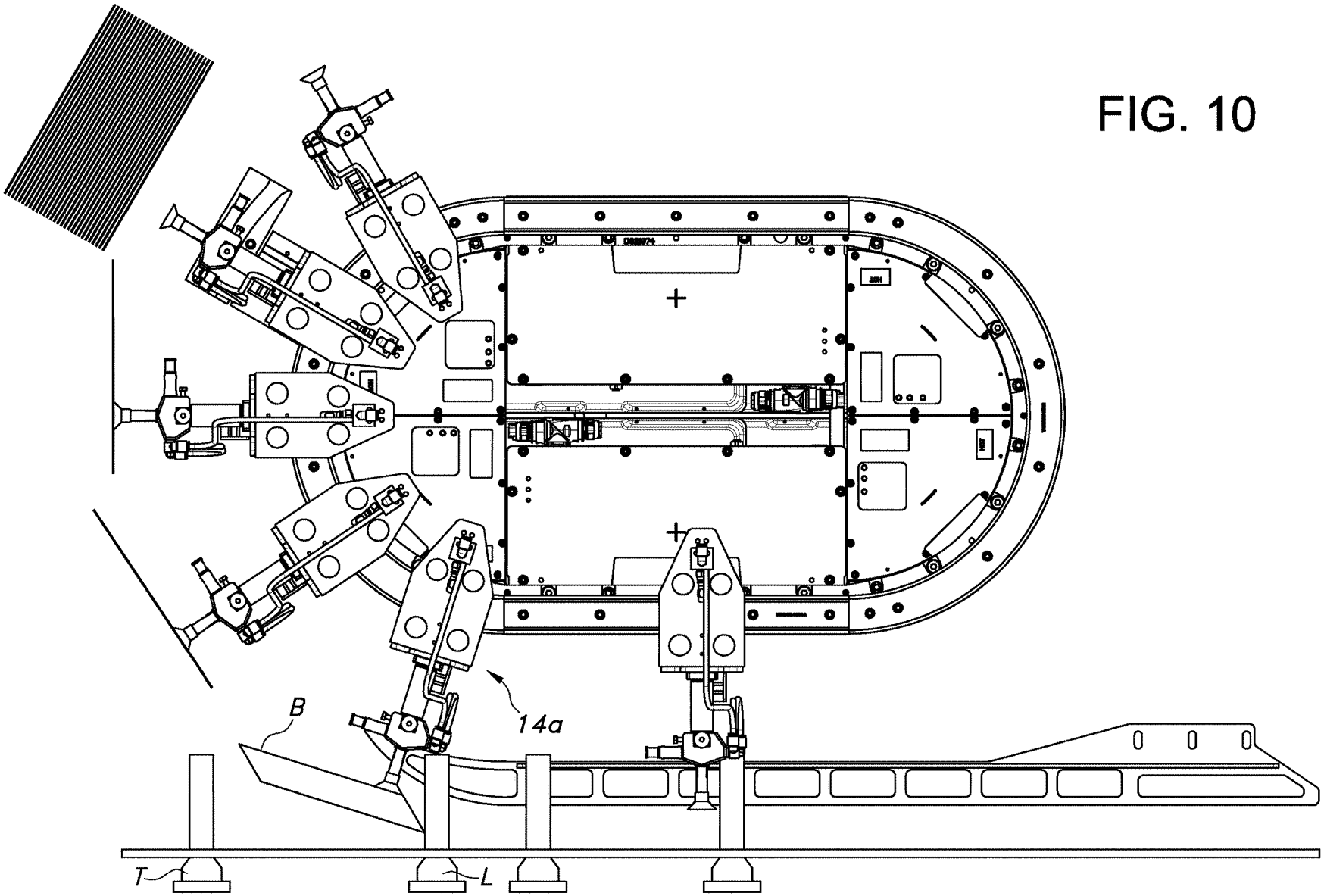
Figure 11:
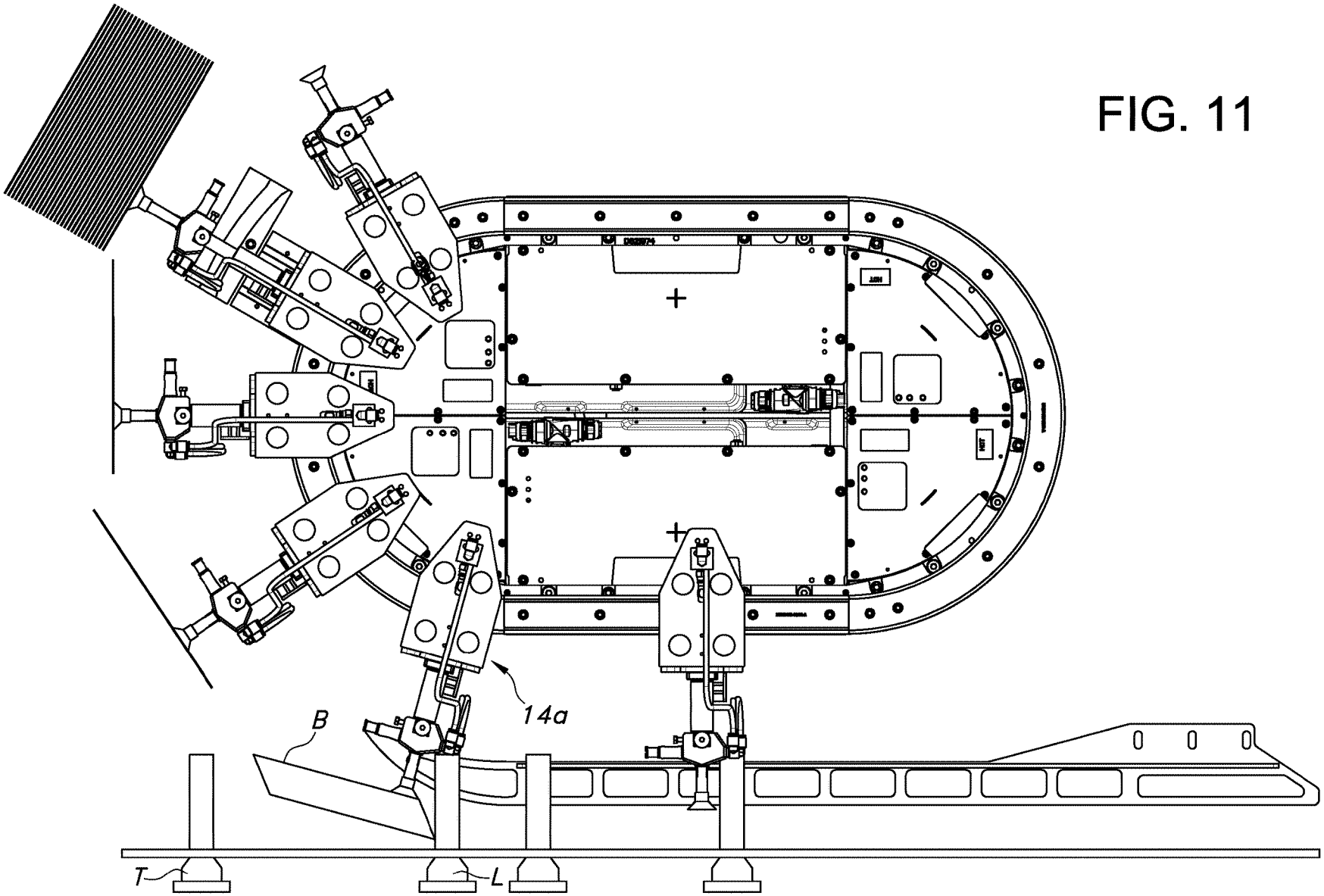

FIGS. 5-14 sequentially illustrate the full sequence of the carton picking and forming operation in relation to the engagement of a selected mover 14. In FIG. 5, the retraction of the carton blank B by one mover 14*a* is shown. This mover 14*a* may be moved along the track 12 such that the still not erected carton blank B associated with it engages an advance structure, such as a leading lug L on an adjacent takeaway conveyor, which starts the erection (FIG. 5).

Figure 12:
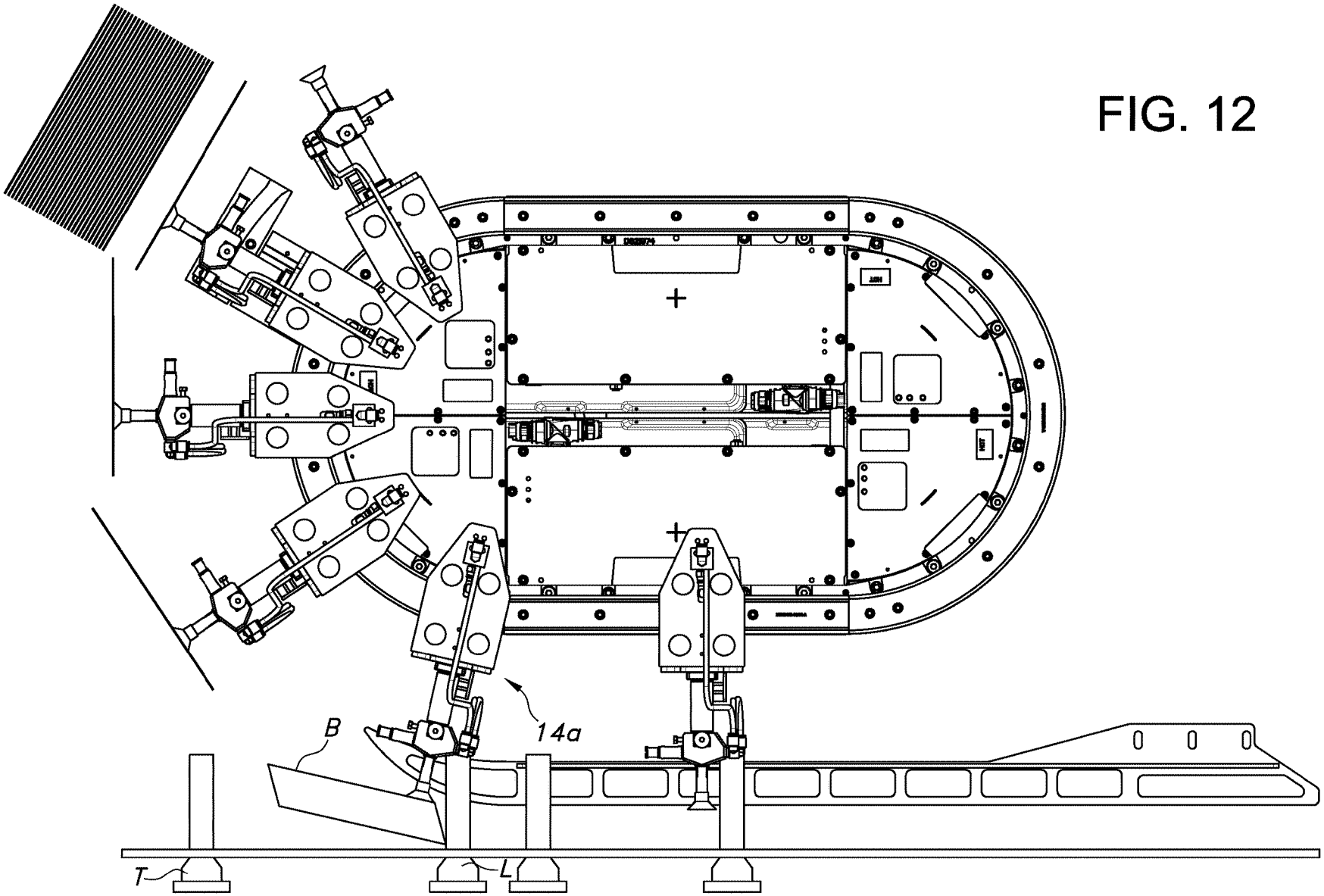
Figure 13:
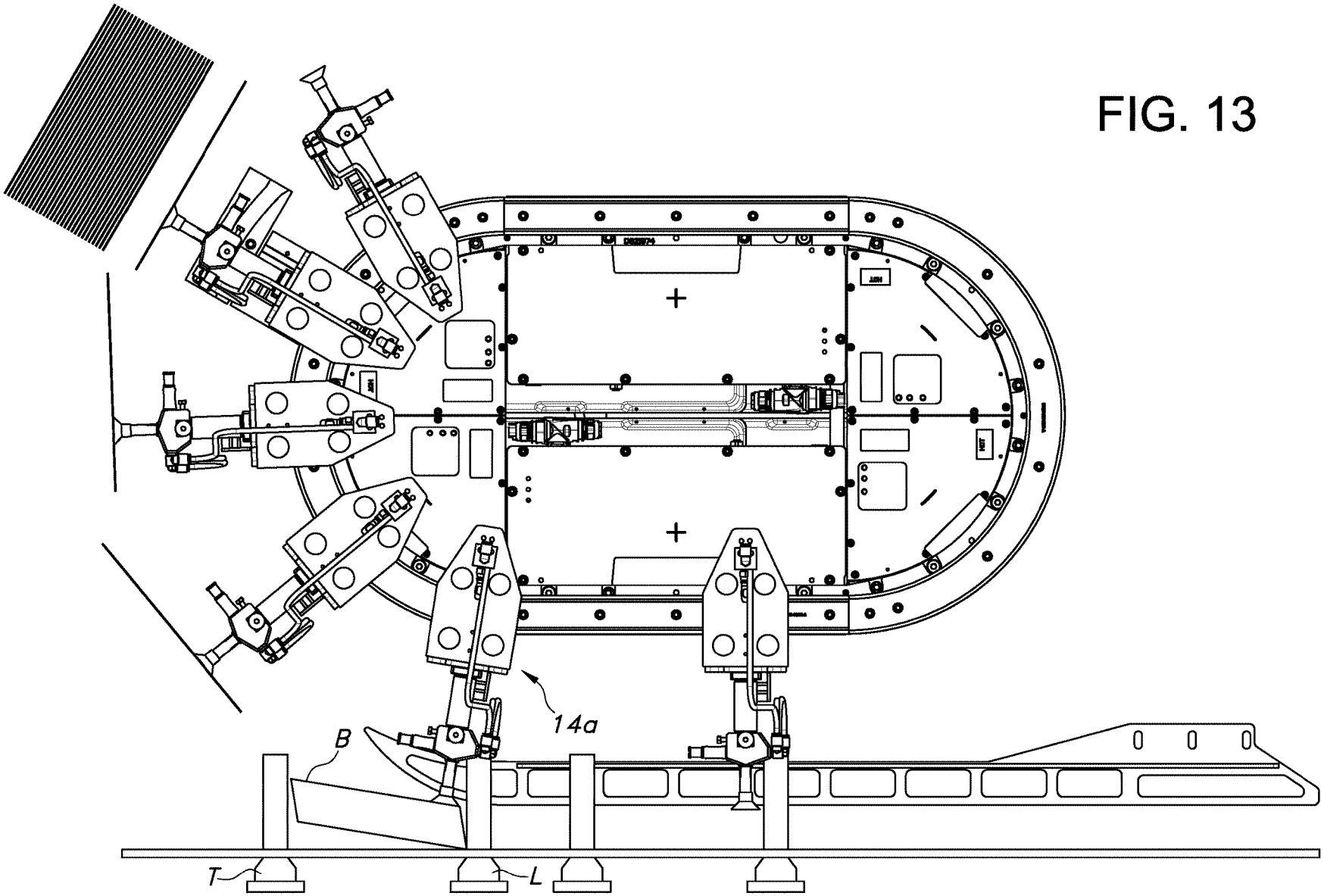
Figure 14:
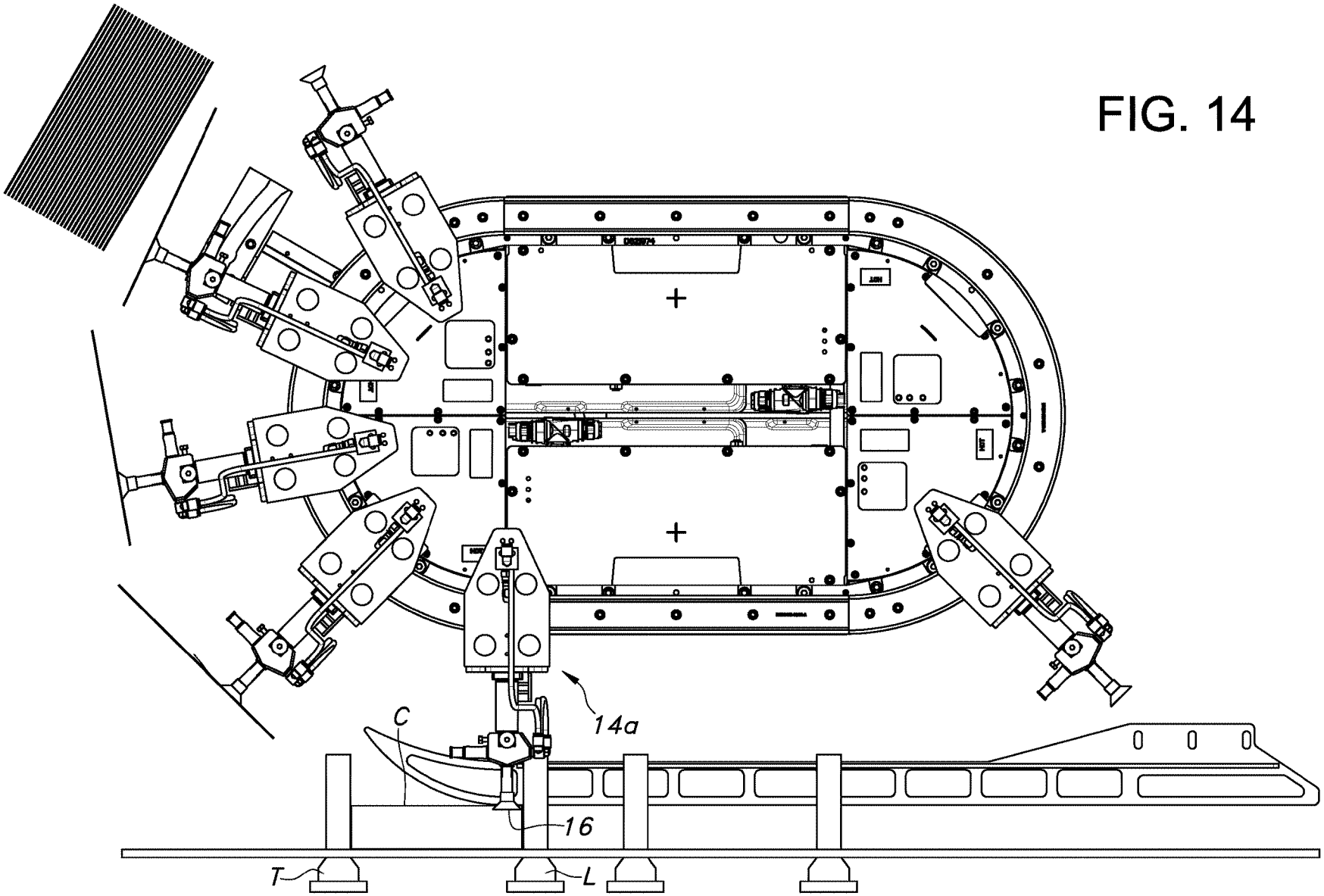

As indicated, the picking of the blank B may occur above a midline of the track 12 (that is, along the upper curved portion), to allow for the carton blank B to be erected with the assistance of the movement of the mover 14 around the remainder of the curved portion, and ultimately to the underside of the track 12 along linear portion 12*b*, as shown in FIG. 12. The carton blank B eventually forms the carton C in an open condition and ready for receiving product, while simultaneously engaged by the lug L and the vacuum cups 16, which may be released at the point of erection by discontinuing the vacuum pressure. During the latter part of the sequence, a trailing lug T may also be used to help square the nascent carton C and complete the forming process.

As contrasted with past feeders and formers relying solely upon continuous rotary movement, it can be appreciated that this machine 10 uses controlled motion technology to allow for a more precise handling of the carton during picking and erection, and a consequent control of the timing of the required events to complete the erection sequence. The resulting pitchless arrangement may be used with a variety of different carton sizes (lengths in particular) without making any mechanical adjustment to the machine 10 (but of course possibly altering the relative positioning of the lugs L, T to accommodate the corresponding carton length). The arrangement also allows the movers 14 to be operated at variable speeds, which may be desirable in conveying the carton blanks for erection. This is simply not easily achieved or perhaps even possible using known arrangements of rotary feeders involving continuous rotation (as compared to controlled movement).

While different shapes may be used (such as, for instance, circular), it can also be appreciated that the track 12 shown is oblong. Thus, it includes curved portions 12*a*, as discussed above, as well as linear portions 12*b* (see FIG. 5) along which the movers 14 move, including in a depending position during the erection sequence. As a result of this arrangement, and as can be understood from FIGS. 5-14, a mover (such as mover 14*b*) may advance with the carton C during the lug engagement and thus help to assure that the erection is reliably achieved.

During the continued conveyance along the linear portion 12*b* of the track 12 corresponding to the lugged takeaway conveyor, the vacuum cups 16 may continue to engage and actively apply a suction force to the carton blank during some or all of the erection sequence. This may be advantageous not only in terms of helping to provide the force for erection, but also to ensure that it is achieved in a consistent, reliable manner. The corresponding linear portion 12*b* along the opposite side of the track 12 also provides a location where the movers 14 may be parked awaiting actuation for the next pick operation (note "park positions" in FIG. 1). The movers 14 may also be accelerated for return to the park position once the carton C is formed.

Figure 15:
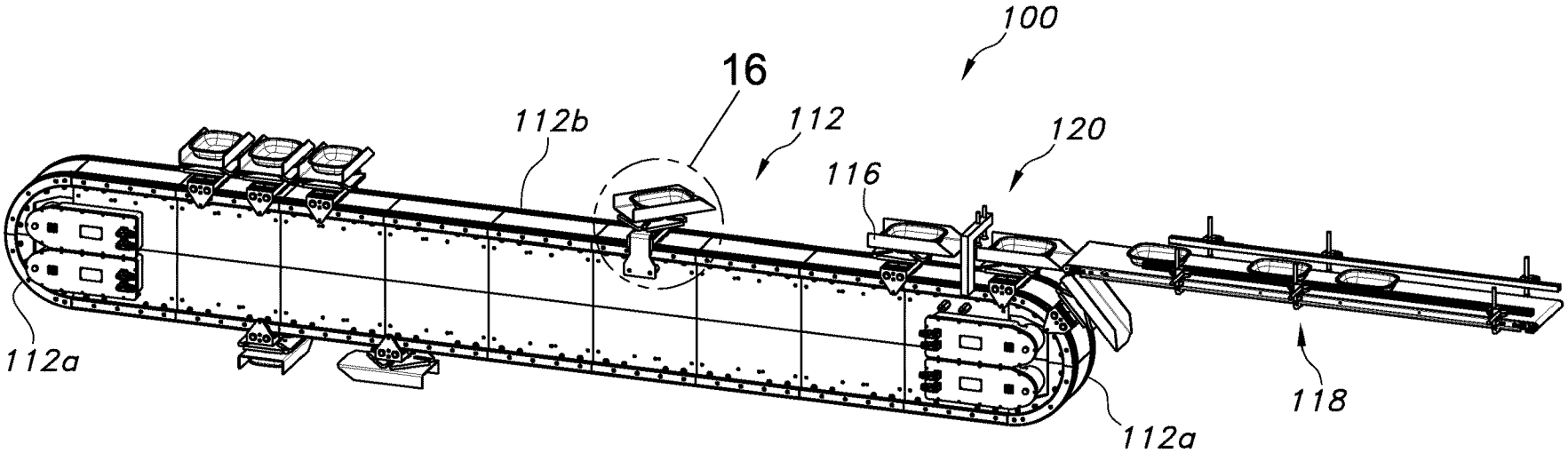
FIG. 15 is a side perspective view of a carton loading machine including a continuous motion device.
Figure 16:
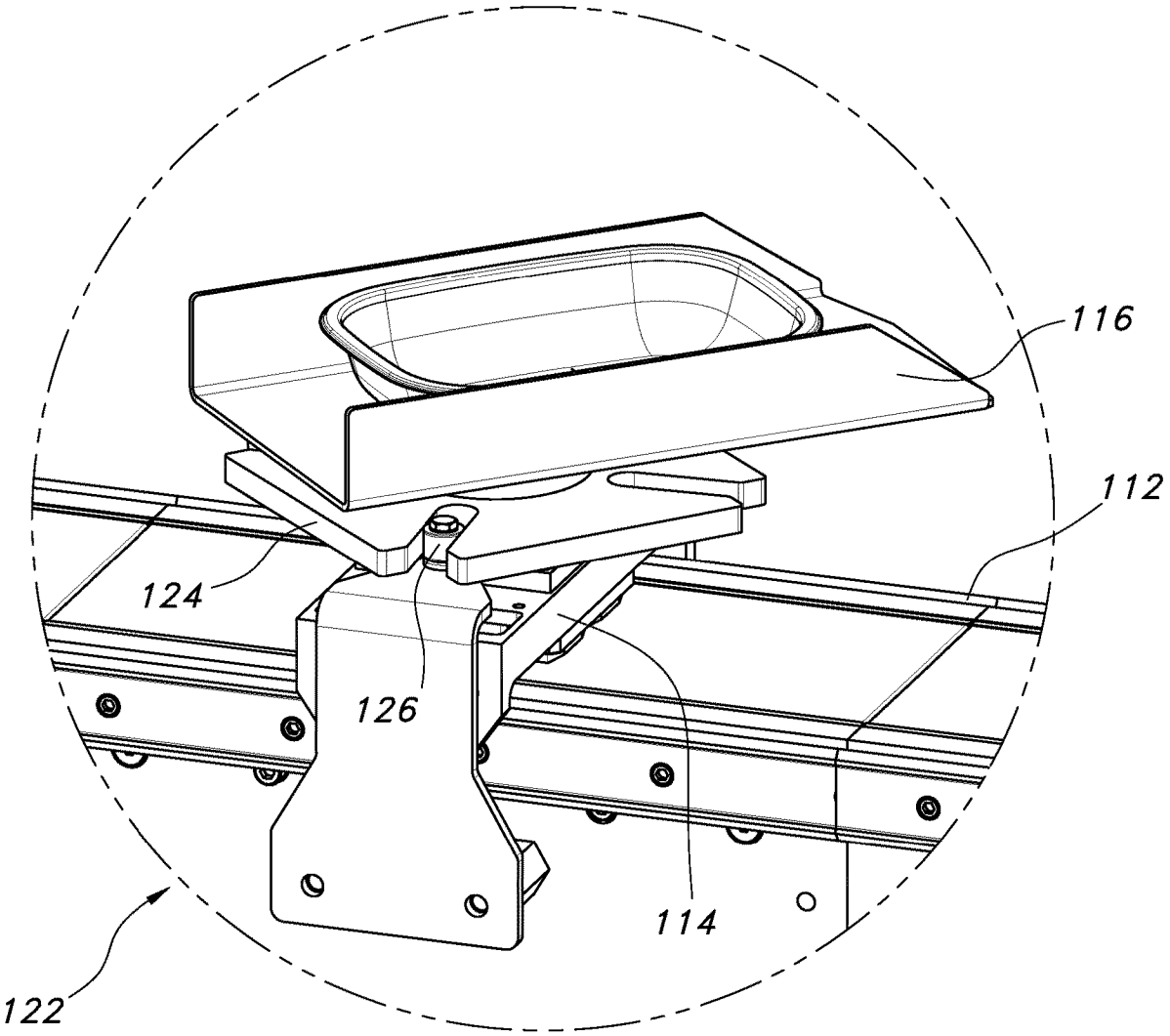
FIG. 16 is an enlarged view of a part of the machine of FIG. 15.

Once the erection sequence is complete, it may also be desirable to load the now-erected carton C with product. This may be achieved using an adjacent product delivery machine 100, an example of which is shown in FIGS. 15 and 16. The machine 100 also includes a track 112 for providing controlled motion for individual movers 114 (that is, the movers may be independently moved along the track at a particular speed (or not)). The track 112 as shown includes an upper elongated portion 112*b* forming a forward run, as well as curved portions 112*a* for returning the movers 114 to the forward run.

Each mover 114 may be adapted for receiving and supporting a product during conveyance. In the illustrated embodiment, the mover 114 includes a carrier, such as a bucket 116, for achieving this function. The bucket 116 may be mounted to the mover 114 for relative rotation, and may have an open top as well as open ends for receiving product.

As can be understood from the right hand side of FIG. 15, the bucket 116 may be initially oriented with one open end facing an infeed conveyor 118, which in turn delivers the product thereto. Each mover 114 may be momentarily halted at the delivery point, and a retainer 120 (such as a vertically extending linear actuator) used to ensure that the product is retained in or on the bucket 116 prior to advancing along the track 112 (possibly with an acceleration to close any gap created by the delayed action). Advantageously, the controlled movement provided by the track 112 also allows for the flow of movers 114 to be controlled to correspond to the feed of product on the conveyor 118, which may be random.

With the product onboard, the mover 114 may then extend along the upper linear portion 112*b* of the track 112 to a remote point for delivery into the open end of the carton C (see FIG. 15) associated with machine 10 (or a different machine, such as a conventional rotary feeder arrangement with a corresponding takeaway conveyor). As can be appreciated, when the machines 10, 100 run in parallel, the bucket 116 in the above-described condition is generally orthogonal to the orientation of the carton C.

In such case, it would be necessary to reorient the bucket 116, which may be achieved using a device, such as a turner 122 (such as a slotted, or "Geneva", wheel 124 and a corresponding fixed cam follower 126, as shown in FIG. 16). With the bucket 116 reoriented in this fashion (which is shown as being a 90 degree counterclockwise turn), the product may then be delivered through the open end of an adjacent carton (such as by using a pusher (not shown) the push the product into place). The now-filled carton may then be sealed and thus completed. Along the return run of the track 112, a device for turning or turner (not shown, but substantially identical to cam arrangement 122) may be arranged to return the bucket 116 to a position for receiving the product from the conveyor 118 at the infeed point, such that the sequence may be continuously repeated.

As should be appreciated, the tracks 12, 112 described above are shown as including a particular number of movers 14, 114 (six in FIG. 1, nine in FIG. 15). However, the number of movers provided may be varied depending on the particular application (and would typically be greater in the machine 100, since there would likely be a desire for continuous conveyance of product). As can be appreciated, use of the controlled movement also allows for the movers 14, 114 to be halted at any point along the return run to await actuation upon being summoned to engage a carton or product, respectively. As noted above for the cartoning machine 10, the movers 114 may also be controlled to regulate their relative spacing, depending on the size or length of the buckets 116 used.

The foregoing description has been presented for purposes of illustration. It is not intended to be exhaustive or to limiting. The embodiments described provide an illustration of the inventive principles and the practical application thereof sufficient to enable one of ordinary skill in the art to utilize them in various other embodiments and with various modifications, as are suited to the particular use contemplated. All such modifications and variations are within the scope of the invention as determined by the appended claims when interpreted in accordance with the breadth to which they are fairly, legally and equitably entitled.

The invention claimed is:

1. A machine for forming a carton from a carton blank in a hopper, comprising:

at least one mover including a picker for picking the carton blank from the hopper and associating the carton blank with the mover; and a controlled motion track for moving the at least one mover and picker along a path of travel to a stationary position for engaging the carton blank in the hopper.

2. The machine of claim 1, wherein the picker comprises an actuator for moving the picker in a linear direction for engaging and withdrawing the carton blank from the hopper while the mover is in the stationary position.

3. The machine of claim 2, wherein the picker comprises at least one vacuum cup for engaging the carton blank, the vacuum cup being mounted to the mover by a support including a vacuum source for supplying vacuum pressure to the vacuum cup.

4. The machine of claim 3, further including a latch for latching the picker in a home position.

5. The machine of claim 3, further including a rotary union for delivering gas to the support.

6. The machine of claim 1, wherein the track comprises a curved portion corresponding to the location of the hopper and a linear portion.

7. The machine of claim 1, further including a takeaway conveyor for receiving the carton blank during erection, the takeaway conveyor being located opposite a linear portion of the track.

8. The machine of claim 1, further including a plurality of movers, the controlled motion track adapted for controlling the movement of each mover to stop at the hopper.

9. The machine of claim 1, wherein the mover comprises a first mover, and further including a second mover having an actuator for moving the mover in a linear direction for engaging and withdrawing the carton blank from the hopper while the mover is in the stationary position.

10. A machine for forming a carton from a carton blank in a hopper, comprising:

a plurality of movers, each including a picker connected to an actuator for causing the picker to pick the carton blank from the hopper; and a controlled motion track for delivering the movers and associated blanks to a position for erection of the blank into the carton, the track including a linear portion.

11. The machine of claim 10, wherein the controlled motion track is adapted for moving the at least one mover and picker along a path of travel to a stationary position for engaging the carton blank in the hopper.

12. The machine of claim 10, further including a takeaway conveyor for receiving the carton blank during erection, the takeaway conveyor being located adjacent a transition from a return run of the track to a forward run.

13. The machine of claim 10, further including a takeaway conveyor comprising lugs for assisting in erecting the carton from the carton blank during conveyance along the linear portion of the track by the combined action of the lugs and the picker.

14. The machine of claim 10, wherein the track includes a curved portion.

15. The machine of claim 14, further including a hopper positioned opposite the curved portion of the track.

16. A machine for forming a carton from a carton blank, comprising:

a controlled motion track having a curved portion and a linear portion;

a hopper for holding the carton blank, the hopper being located along the curved portion of the track;

at least one mover for moving along the track, the mover including at least one picker for engaging the carton blank in the hopper and conveying the carton blank along the curved portion of the track to the linear portion of the track; and a conveyor for receiving the carton blank and at least partially erecting it, the conveyor being located along the linear portion of the track, whereby the picker engages the carton blank at least partially during erection by the conveyor.

17. The apparatus of claim 16, wherein the picker is adapted for applying suction to the carton blank during conveyance along the curved portion and the linear portion of the track.

* * * * *